US006629863B2

(12) United States Patent
Kieninger et al.

(10) Patent No.: US 6,629,863 B2
(45) Date of Patent: Oct. 7, 2003

(54) VEHICLE BATTERY PLUG-IN CONNECTION ARRANGEMENT

(75) Inventors: Hans Kieninger, Stuttgart (DE); Rudolf Andraschko, Pluederhausen (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 281 days.

(21) Appl. No.: 09/803,326

(22) Filed: Mar. 9, 2001

(65) Prior Publication Data

US 2001/0023037 A1 Sep. 20, 2001

(30) Foreign Application Priority Data

Mar. 14, 2000 (DE) ..... 100 12 387

(51) Int. Cl.[7] ..... H01R 4/42
(52) U.S. Cl. ..... 439/764; 439/754
(58) Field of Search ..... 439/764, 754, 439/357, 358, 317, 319, 522

(56) References Cited

U.S. PATENT DOCUMENTS

| | | | | | |
|---|---|---|---|---|---|
| 3,287,031 | A | * | 11/1966 | Simmons | |
| 3,909,301 | A | * | 9/1975 | Schenk, Jr. | 136/134 |
| 3,933,406 | A | * | 1/1976 | Cameron et al. | 439/111 |
| 4,675,255 | A | * | 6/1987 | Pfeifer et al. | 429/92 |
| 4,895,530 | A | * | 1/1990 | Gugelmeyer et al. | |
| 4,906,205 | A | * | 3/1990 | Viles | 439/504 |
| 4,964,819 | A | * | 10/1990 | Caraballo | 439/773 |
| 5,066,905 | A | * | 11/1991 | Betton et al. | 324/133 |
| 5,496,197 | A | * | 3/1996 | Grivet | |
| 5,597,331 | A | * | 1/1997 | Gable et al. | 439/754 |
| 5,612,659 | A | * | 3/1997 | Kerber | 335/177 |
| 5,626,493 | A | * | 5/1997 | Post et al. | 439/555 |
| 5,707,250 | A | * | 1/1998 | Smithson | 439/504 |
| 5,713,765 | A | | 2/1998 | Nugent | |
| 5,738,553 | A | * | 4/1998 | Pilotti | 439/763 |
| 5,805,047 | A | * | 9/1998 | De Villeroch et al. | 337/290 |
| 5,885,088 | A | * | 3/1999 | Brennan et al. | 439/680 |
| 5,980,334 | A | * | 11/1999 | Pyles | 439/764 |
| 6,132,234 | A | * | 10/2000 | Waidner et al. | 439/358 |
| 6,162,098 | A | * | 12/2000 | Cheng et al. | 439/621 |
| 6,290,525 | B1 | * | 9/2001 | Jacobi | 439/319 |
| 6,459,233 | B1 | * | 10/2002 | Liang | 320/105 |

FOREIGN PATENT DOCUMENTS

| | | | | |
|---|---|---|---|---|
| DE | 38 21 861 C2 | | 3/1993 | |
| DE | 44 08 834 A1 | | 9/1995 | |
| DE | 196 09 571 A1 | | 3/1996 | |
| DE | 29717896 | | 1/1998 | |
| EP | 0154412 | * | 11/1985 | H01R/13/627 |
| FR | 274 5123 | | 8/1997 | |
| JP | 041 38663 | | 5/1992 | |
| JP | 11054184 A | | 2/1999 | |
| JP | E-1256 | | 1/2000 | |
| WO | WO 9719496 | | 5/1997 | |

* cited by examiner

*Primary Examiner*—Tho D. Ta
*Assistant Examiner*—Larisa Z Tsukerman
(74) *Attorney, Agent, or Firm*—Roger C. Turner

(57) ABSTRACT

A connection arrangement enables rapid connection and disconnection of a cable wire (11) to a post-shaped automobile battery terminal (12). A battery terminal connector (16), has a platform (17) with a front end forming a post-receiving hole (18) that receives the battery terminal, the platform having a rear end with a pair of stationary shoulders (21) and a pin contact (22) lying between the shoulders. A cable connector (25) includes a socket contact (26) that can connect to the battery connector, and a locking device. The locking device has a pair of clamp arms (31) that are resiliently biased together but that are deflected apart by a separator (38) until the arm shoulders (35) snap behind the stationary shoulders.

5 Claims, 9 Drawing Sheets

FIG. 5
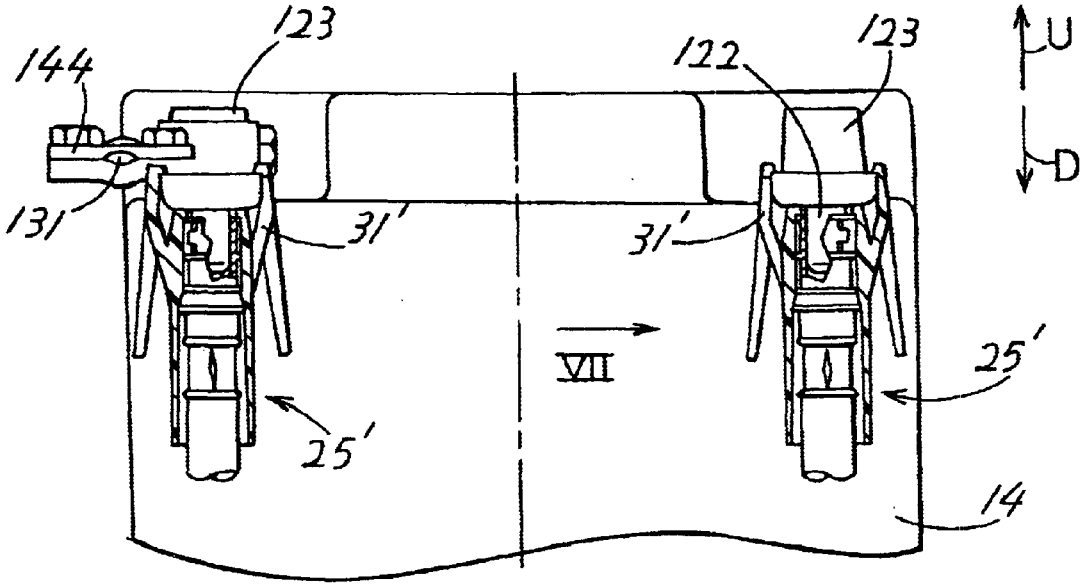
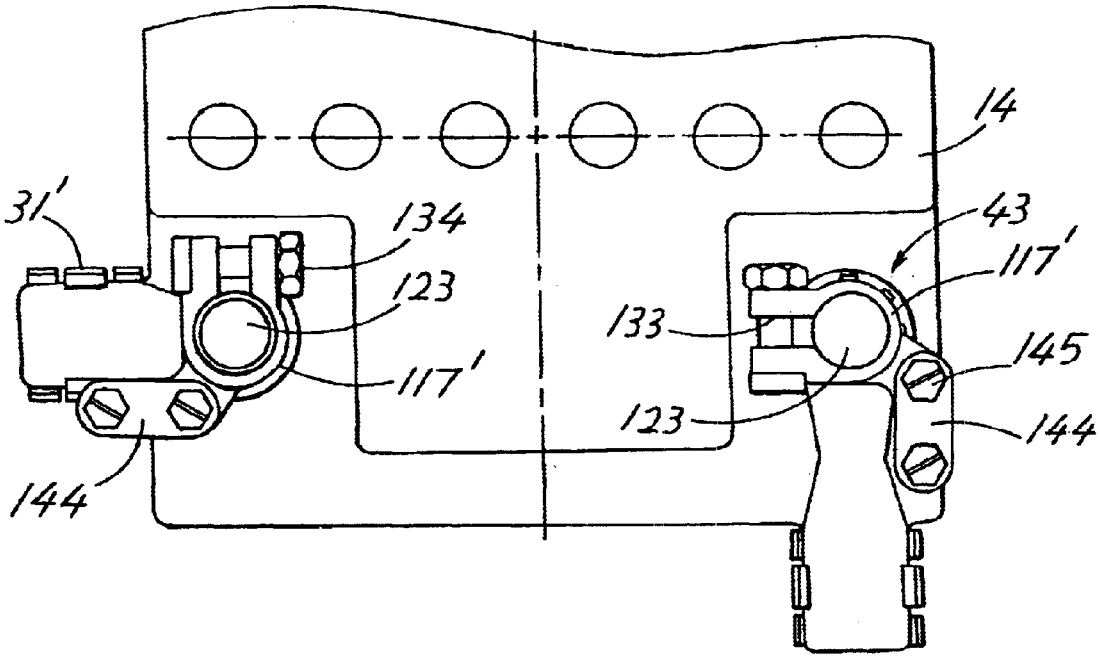
FIG. 6

VEHICLE BATTERY PLUG-IN CONNECTION ARRANGEMENT

CROSS-REFERENCE TO RELATED APPLICATION

Applicant claims priority from German patent application 100 12 387.2 filed Mar. 14, 2000.

BACKGROUND OF THE INVENTION

Present vehicles commonly have 12 volt batteries with a battery casing and with a pair of largely cylindrical posts projecting from the casing. A common type of fitting for connecting a high amperage cable wire to a battery post includes a front end forming a slit ring that is pushed over the post and clamped to it, and a rear end that has lugs that are clamped against opposite sides of the bared cable wire by a screw. The connection and release of the fitting connection to the battery terminal is relatively inexact and complicated, and exposes the worker to the battery terminals and sparks that may occur there at. There are proposals for vehicle batteries that supply a higher voltage, such as 42 volts. This results in the need for somewhat lower current-carrying capacity, but better protection of a worker from the voltage of the battery. A connector arrangement for vehicle batteries, which facilitated connection and disconnection of a cable wire to the battery terminal, would also be desirable in facilitating connections to the vehicle electrical system as in starting a vehicle when the battery is run down.

SUMMARY OF THE INVENTION

In accordance with one embodiment of the present invention, a vehicle battery connector arrangement is provided, which simplifies connection and disconnection of a cable wire to the battery terminal while better protecting a worker who performs such connection and disconnection. The connection arrangement includes a battery connector designed to be fixed to a battery terminal and a cable connector designed to be fixed to a cable conductor. The connectors have pin and socket contacts that enable quick mating and unmating. A locking device holds the connectors together, but enables rapid release so the connectors can be unmated. The locking device includes an insulative sheath that surrounds a conductive insert that form one of the contacts, to isolate a workman who holds the cable connector, from the voltage of the battery.

The locking device can include a pair of resilient catch arms that are deflected apart, until they snap in front of stationary shoulders on the platform of the battery connector, at which time the pin and socket contacts have been fully mated. Disconnection is accomplished by spreading apart the catch arms.

The novel features of the invention are set forth with particularity in the appended claims. The invention will be best understood from the following description when read in conjunction with the accompanying drawings.

BRIEF DESCRIPTION OF THE DRAWINGS

FIG. 5 is a partially sectional front elevation view of a connector assembly shown secured on a pair of battery terminals, and constructed in accordance with another embodiment of the invention.

FIG. 6 is a plan view of the connector assembly of FIG. 5.

DESCRIPTION OF THE PREFERRED EMBODIMENTS

Figure 1:
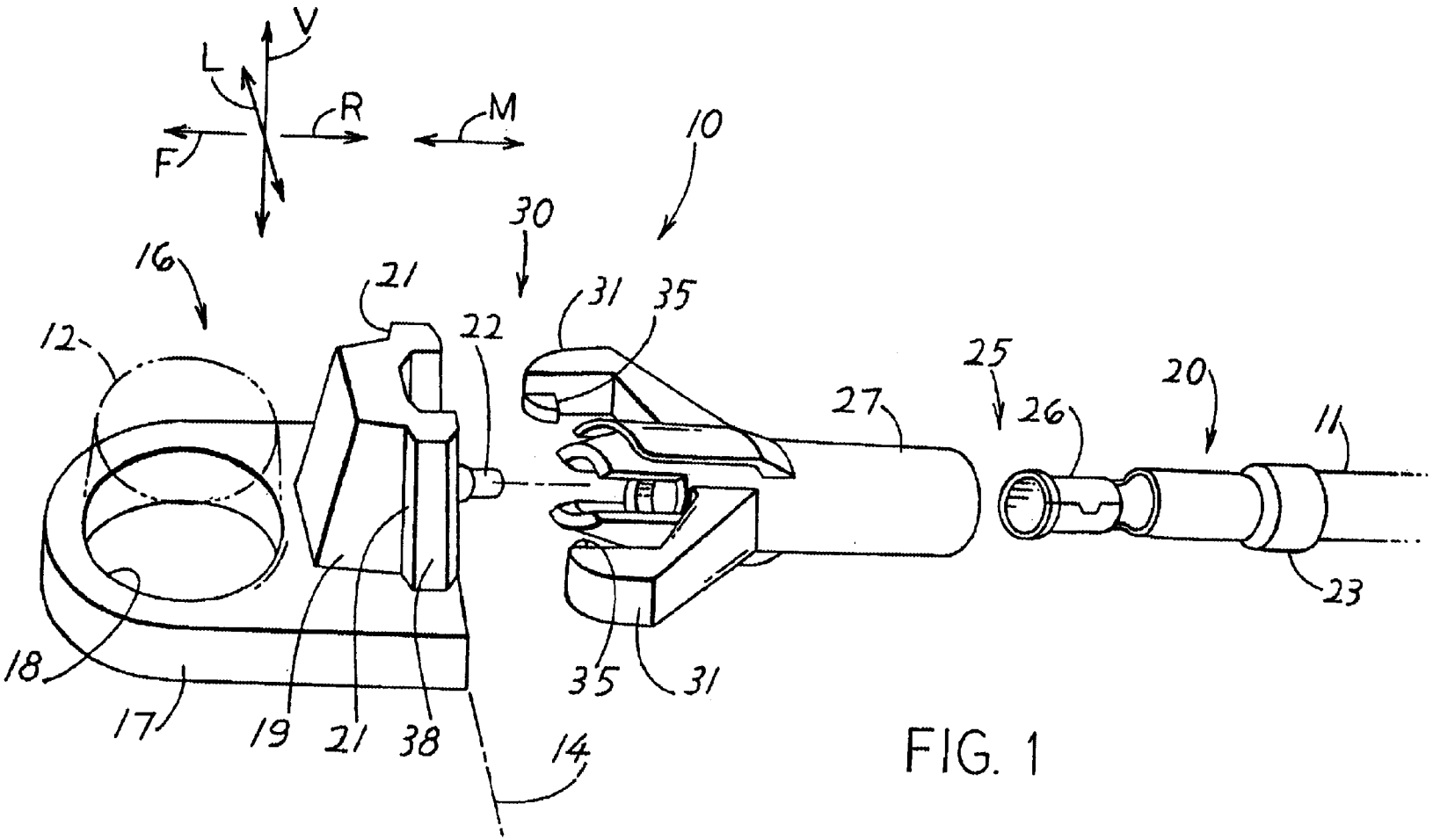
FIG. 1 is an exploded isometric view of a connector assembly of the present invention, showing how it connects a cable wire to a vehicle battery terminal.
Figure 1A:
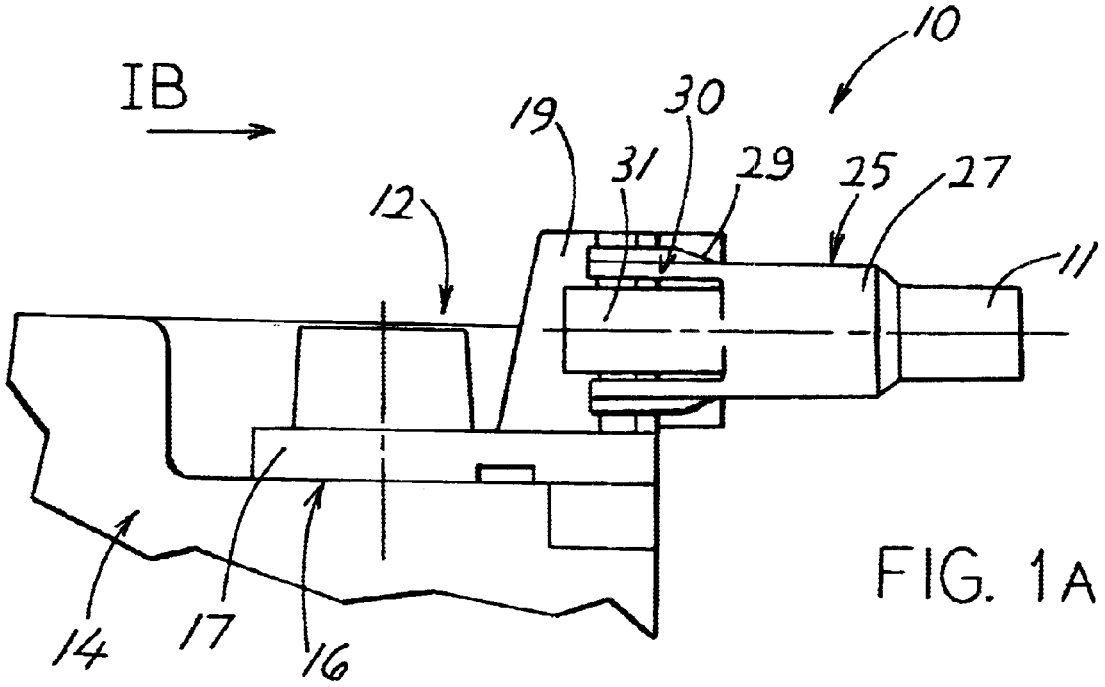
FIG. 1A is a side elevation view of the assembled connector assembly of FIG. 1 and a portion of a vehicle battery, with the connectors of the assembly shown fully mated.
Figure 1B:
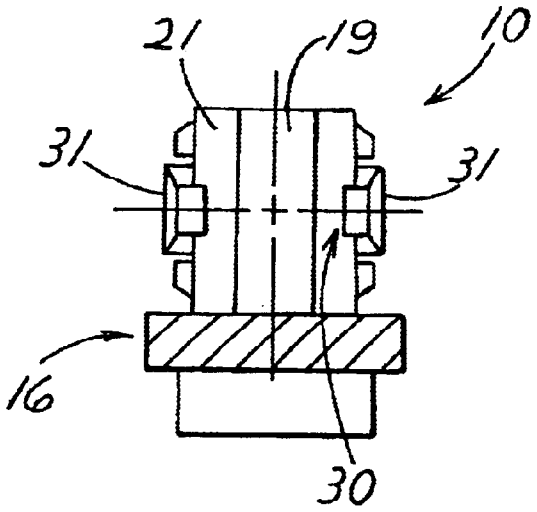
FIG. 1B is a view taken on line 1B of FIG. 1A.

FIG. 1 illustrates a connector assembly 10 of the invention for connecting a single wire or conductor 11 of a cable, to a battery terminal 12 of a vehicle-type battery 14. Such terminal is usually in the form of an upwardly projecting post. The assembly includes a battery connector 16 that connects to the battery terminal 12 and a cable connector 25 that connects to the cable wire 11. The two connectors can be mated and unmated to make and break the connection of the cable to the battery terminal.

The battery connector 16 includes a platform 17 with a front F end forming a hole 18 that closely receives the battery terminal 12. When the terminal is tapered, the platform front end can be hammered down around the terminal, although it also can be clamped in place by forming the platform front end with two sides that can be moved together by tightening a screw. The platform has a rear R end with an upward projection 19 and a pin contact 22. The entire battery connector 16 is formed of electrically conductive material. The front and rear directions extend in longitudinal directions M that are perpendicular to lateral directions L and vertical directions V.

The cable connector 25 includes an electrically conductive insert 20 that includes a socket contact 26 at its front end and a wire terminator 23 at its rear end that can receive the wire 11 and crimp and/or solder to the wire. The socket contact 26 can be moved forwardly to mate with the pin contact 22.

The cable connector also includes an insulative housing 27 that surrounds the insert 20 and that has a pair of catch arms 31. The catch arms are part of a locking device 30 that locks the cable connector to the battery connector. The battery connector 16 has an upstanding rail or projection 19 that forms a pair of laterally-spaced forwardly-facing shoulders 21. The shoulders 21 can be engaged by arm shoulders 35 on the front ends of the catch arms 31. When the conductive insert 20 is inserted into the housing 27 and locked in place therein, forward movement of the cable connector 25 results in the catch arms 31 being laterally L deflected apart as they move across a separating portion 38 of the rail 19. When the catch arms pass forward of the separating portion 38, catch arm shoulders 35 snap forward of the rail shoulders 21, to thereby lock the cable connector to the battery connector. The connectors can be disengaged by pushing apart the catch arms 31, against their resilience.

FIGS. 1A, 1B, 2 and 3 show that the insulative housing 27 has an inward flange 50 (FIG. 2) at the front of its region 28, that locks the conductive insert 20 in the housing 27. The socket contact 26 rests on an overlapping edge of region 28. The rear end at 23 of the conductive insert receives the cable wire 11 and is crimped and/or soldered thereto. The insulative housing forms the catch arms 31 whose catch arms shoulders can snap forward of the stationary shoulders 21 to lock the connectors together. A tool is generally required to spread the arms to release this embodiment of the invention. A sheath part 29 extends partially around the front of the socket contact.

Figure 2:
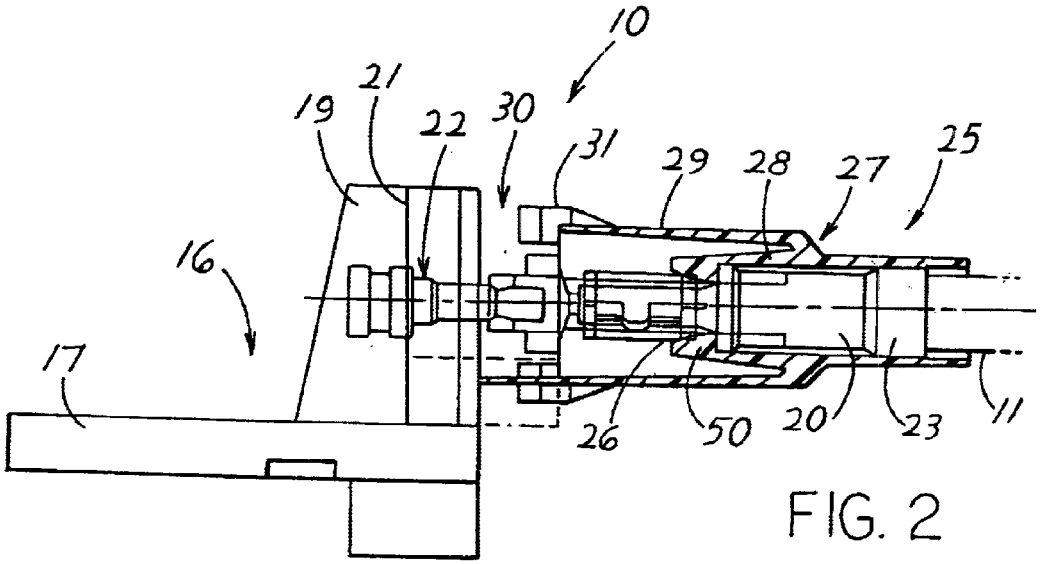
FIG. 2 is a sectional side view of the connector assembly of FIG. 1, with the connectors only partially mated.
Figure 3:
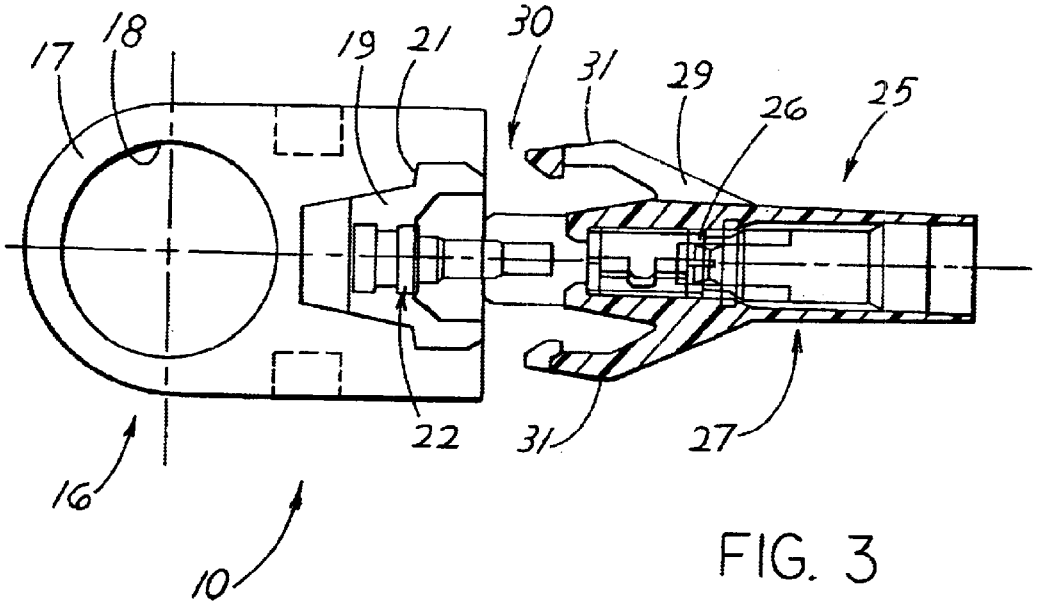
FIG. 3 is a sectional top view of the assembly of FIG. 2.
Figure 4A:
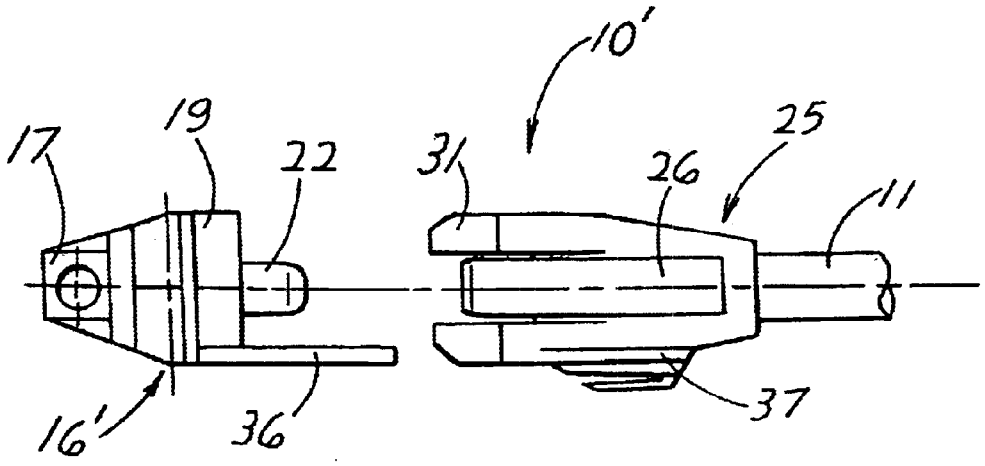
FIG. 4A is an exploded side elevation view of a connector assembly which is similar to that of FIGS. 1–3 but with a variation.

FIG. 4A shows a connector assembly 10' which is a variation of the assembly of FIGS. 1–3. The battery connector 16' has a guide strip 36 that extends parallel to the direction of mating. As the connectors move together, the guide strip 36 enters a slot 37 in the cable connector housing. The guide strip 36 and slot 37 prevent misalignment of the connectors as they approach one another to mate.

Figure 4B:
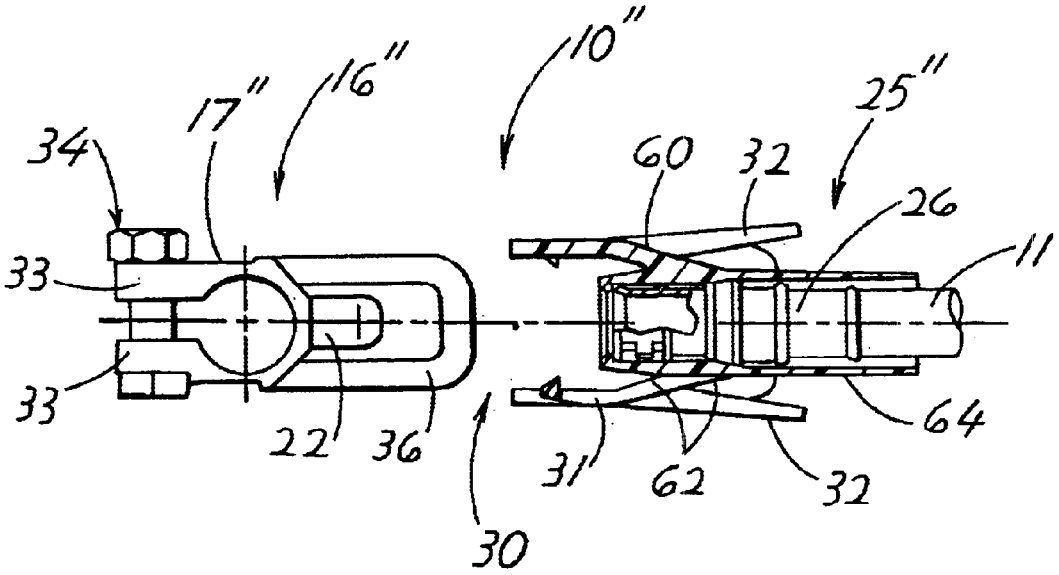
FIG. 4B is a partially sectional top view of the connector assembly of FIG. 4A.

FIG. 4B shows a connector assembly 10" where the cable connector 25" has catch arms 31 that extend rearward to a pair of opposite actuating levers 32. The levers 32 can be squeezed together to spread apart the catch arms 31 so as to release the connectors. Mount parts 60 extend sidewardly, or laterally, to locations 62 on an insulative sleeve 64. The handle rear ends lie rearward of locations 62. The particular battery connector 16" is split into two lugs 33 at the front terminal-engaging end of the platform 17". A screw 34 extends through holes in the split front end and can be screwed tight to clamp the platform to the battery terminal.

Figure 7:
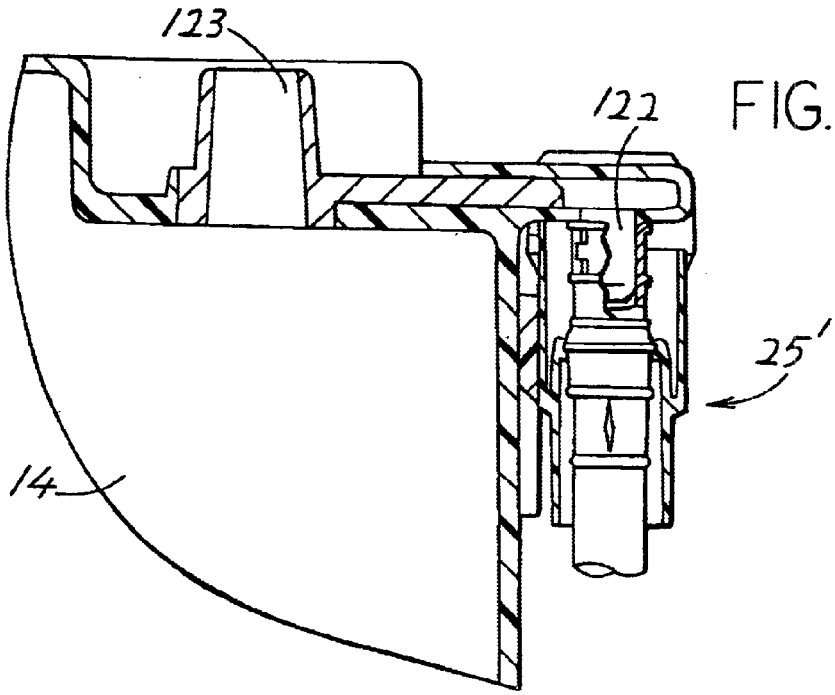
FIG. 7 is a partially sectional view taken along arrow VII of FIG. 5.

In FIGS. 5–7, each connector assembly for each battery terminal 123, is formed by a pin contact 122 that projects downward from the rear end of the platform, to thereby project downwardly along a side of the casing of the battery 14. The cable connector 25' has a socket that connects to the pin 122, and has a pair of catch arms 31' with shoulders that lock against shoulders at the rear of the platform.

FIGS. 5 and 6 show that the battery terminal posts 123 are provided with a conventional clamp connection 43 that includes a platform or lug 117' with flanges 133, and a screw 134 that can clamp the flanges around the battery terminal. The platform 117' is provided with wire clamp lugs 144 that are capable of directly clamping a wire to the battery connector. FIG. 5 shows an opening 131 which is expanded when the screws are unscrewed, with any wire in the opening 131 then clamped by tightening the screws.

Figure 9:
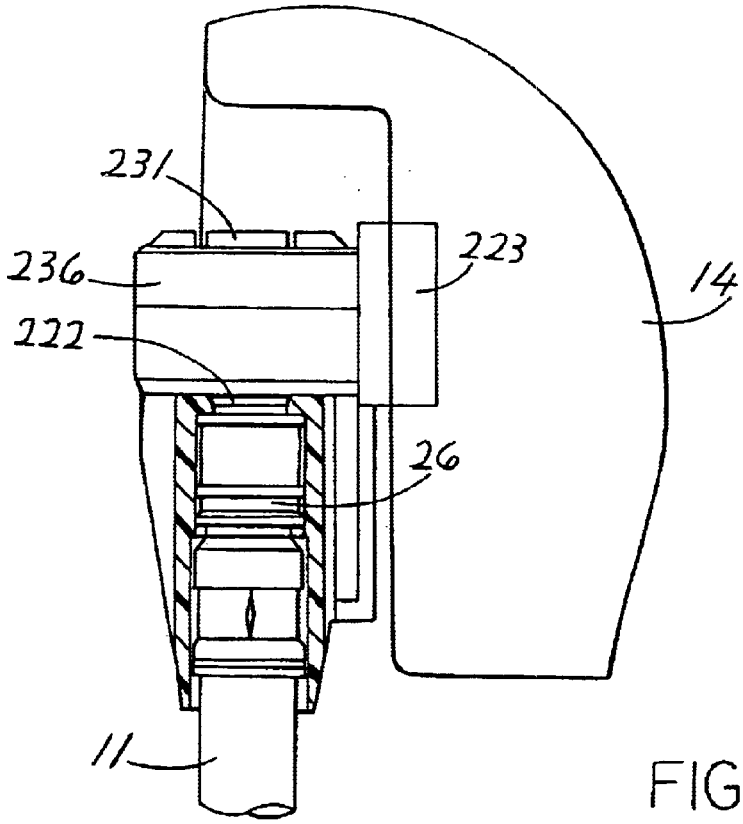
FIG. 9 is a partially sectional side view taken along arrow IX in FIG. 8.
Figure 8:
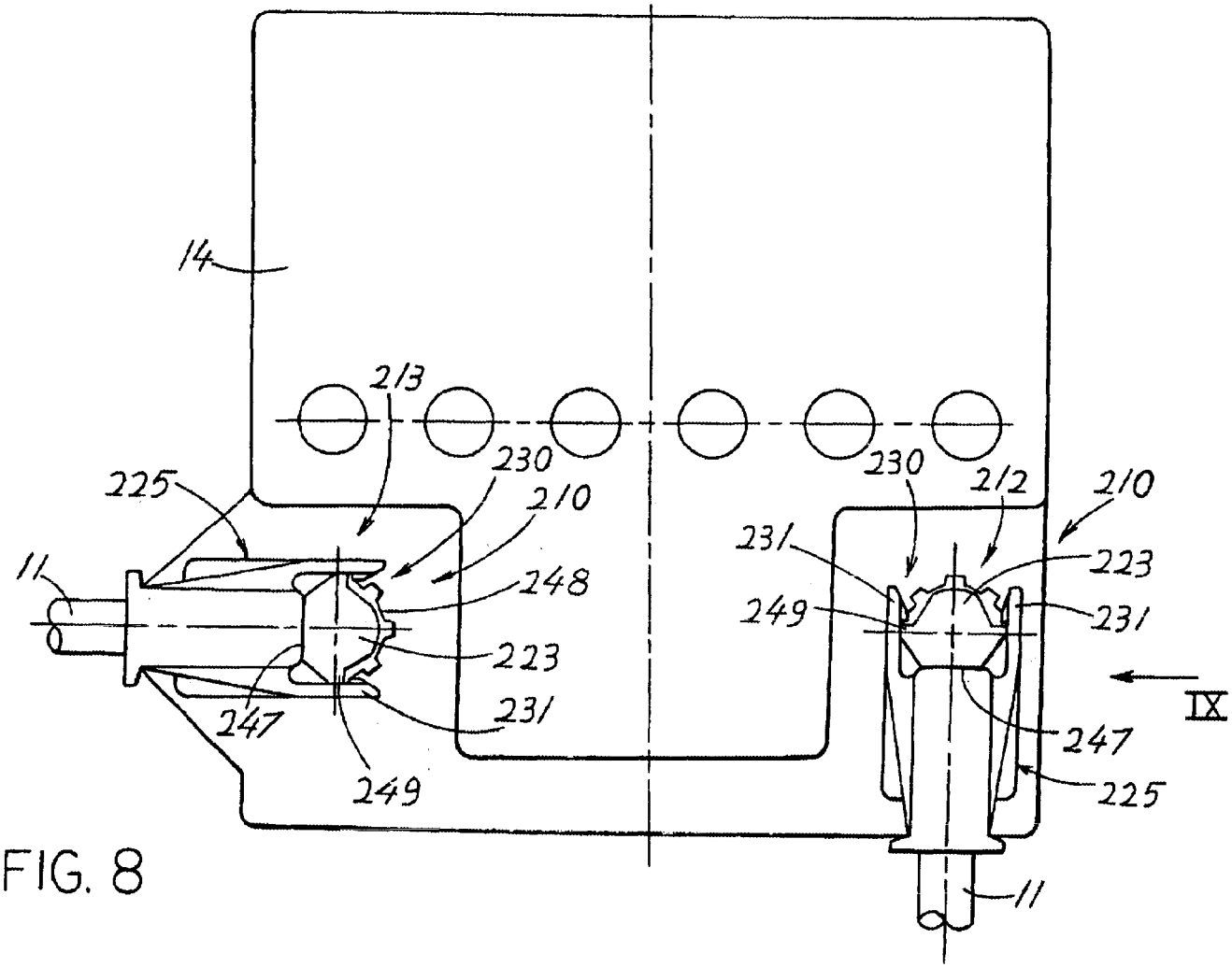
FIG. 8 is a plan view of a connector assembly connected to battery terminals, according to another embodiment of the invention.

FIGS. 8 and 9 show battery connectors 212, 213, each with a post mount 223 and a pin contact 222 (FIG. 9). Each post mount has a set of teeth 249 (FIG. 8). The teeth serve to lock catch arms 231 of a locking device 230 of the cable connector 225.

Figure 10:
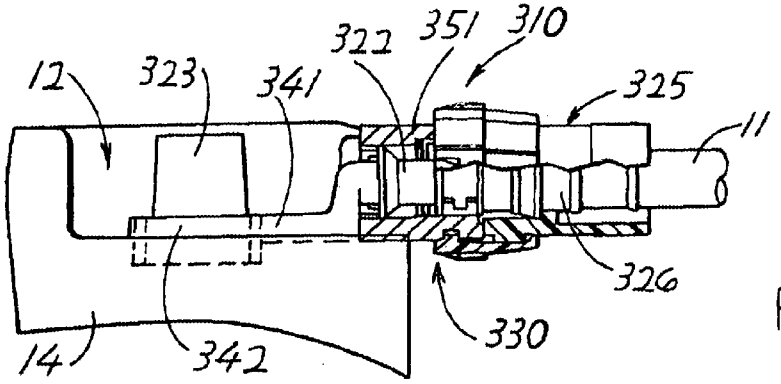
FIG. 10 is a partially sectional side view of a connector assembly in accordance with another embodiment of the invention, shown with a portion of a vehicle battery.
Figure 11:
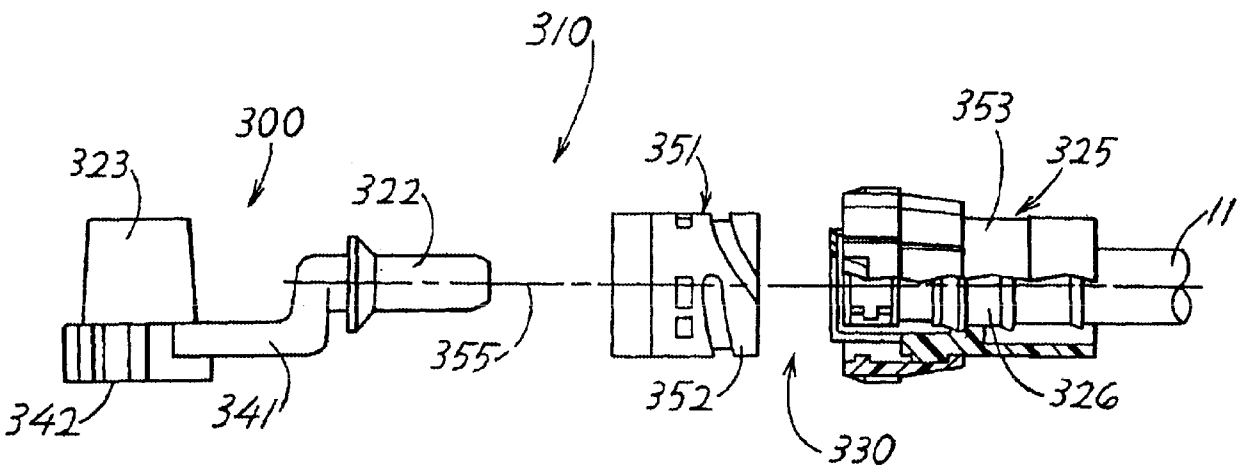
FIG. 11 is an exploded side view of the assembly of FIG. 10, but with only the battery terminal.

FIG. 10–13 show a connector arrangement 310 that includes a battery terminal connector 300 with a platform 342 having a hole that receives a battery terminal 323. The battery terminal connector includes a pin 322 that is offset vertically upward from the platform 342. As shown in FIG. 10, this allows the platform 342 to lie against the bottom of the battery post 323 while the pin contact 322 lies above that level so the socket contact 326 can surround the pin and lie over the battery casing.

The socket contact 326 is fixed in an insulative housing 325. A rotatable sleeve 351 can rotate on the housing and socket contact about a horizontal axis 255. The rotating sleeve 351 has an internal thread that engages a thread on the pin contact 322, by turning the rotating sleeve as the socket engages the pin contact.

Figure 12:
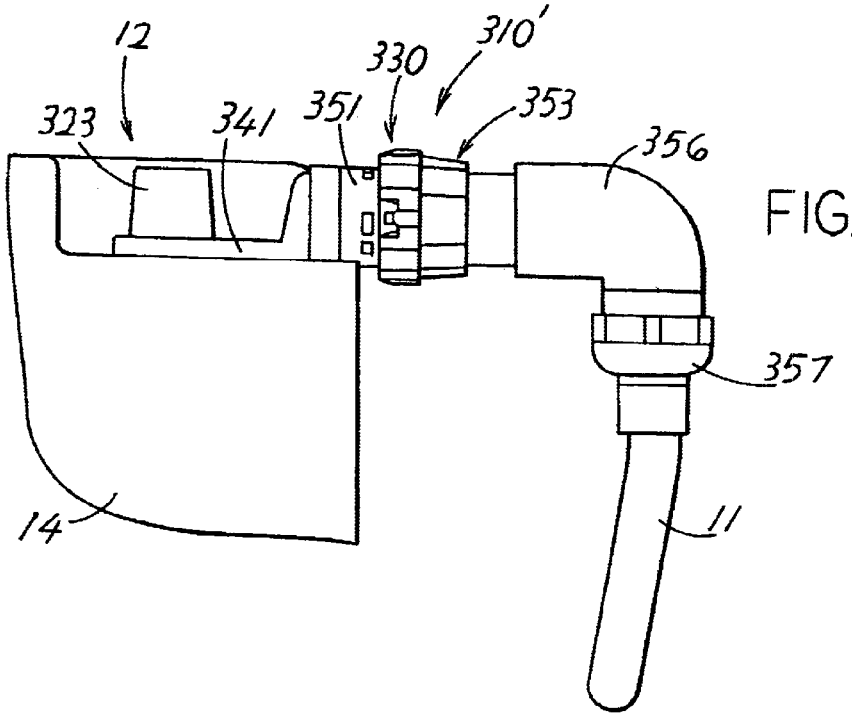
FIG. 12 is a side elevation view of a connector assembly which is a variation of the assembly of FIG. 10.
Figure 13:
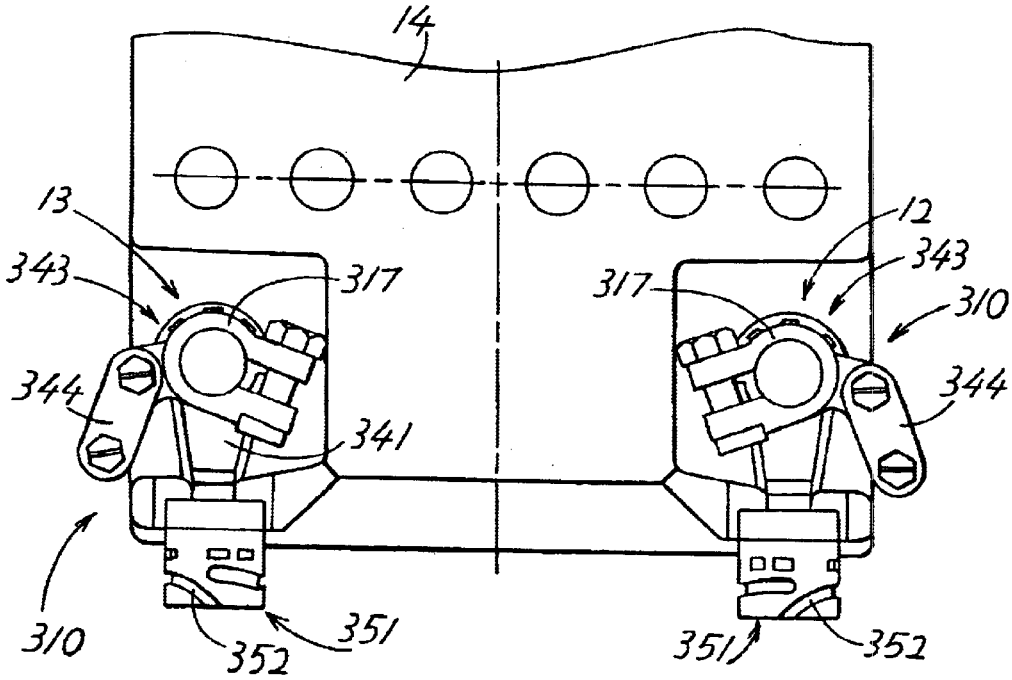
FIG. 13 is a plan view of the assembly of FIG. 10, shown with a portion of a vehicle battery.

FIG. 12 shows a connector assembly 310' in which the cylindrical sleeve 353 is connected to a right angle piece 356 through which the cable wire 11 is guided and sealed with a stopper at 357.

Color or mechanical coding can be provided to indicate the plus and minus battery terminals and corresponding connector assemblies. It is possible to exchange the pin and socket contacts so, for example, the socket contact can be part of the connector that is clamped to the battery terminal while the pin contact is attached to the cable wire.

Thus, the invention provides a connector assembly for easier and safer connection and disconnection of a cable wire to a battery terminal. A terminal connector has a front end clamped or otherwise attached to a battery terminal, and a rear end forming a socket or pin contact. A cable connector includes a corresponding socket or pin contact and is connected to the cable wire. The platform or a projection on it forms forwardly-facing shoulders, and the cable connector has a pair of resilient clamp legs with rearwardly-facing shoulders that snap immediately in front of the stationary shoulders on the platform. As an alternative, a bayonet thread on the battery connector is engaged by a rotatable threaded part on the cable connector to hold the connectors together. In both holding arrangements, engagement requires movement of the clamp arms or locations on the bayonet threaded sleeve, perpendicular to the forward and rearward directions in which the contacts are mated and unmated.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Vehicle battery connection apparatus for connection of a cable conductor to a vehicle battery terminal, comprising:

a conductive battery connector having a front end fixed to said battery terminal and having a rear end forming a first contact, said battery connector forming a pair of forwardly-facing shoulders;

a cable connector having a rear end fixed to said cable and having a front end forming a second contact that is mateable to said first contact;

a housing that includes an insulative sleeve that surrounds said second contact, and a pair of catch arms extending largely forwardly from locations at opposite sides of said sleeve, said catch arms having rearwardly-facing shoulders that snap in front of said forwardly-facing shoulders as said contacts become fully mated;

said battery connector rear end forms a platform with a hole to surround said battery terminal;

said first contact comprises a pin with a front end that lies at the height of said platform and that extends horizontally when said battery terminal extends upward, said pin having a rear end that lies above said pin front end and that extends horizontally, and said pin having a middle with two bends of about 90° each.

2. Vehicle battery connection apparatus for connection of a cable conductor to a vehicle battery terminal, comprising:

a conductive battery connector having a front end fixed to said battery terminal and having a rear end forming a first contact, said battery connector forming a pair of forwardly-facing shoulders;

a cable connector having a rear end fixed to said cable and having a front end forming a second contact that is mateable to said first contact;

a housing that includes an insulative sleeve that surrounds said second contact, and a pair of catch arms extending largely forwardly from locations at opposite sides of said sleeve, said catch arms having rearwardly-facing shoulders that snap in front of said forwardly-facing shoulders as said contacts become fully mated;

said battery rear end includes a largely cylindrical portion that surrounds said battery terminal and that has a plurality of teeth forming said forwardly-facing shoulders.

3. Vehicle battery connecting apparatus for connection of a cable conductor to a vehicle battery terminal in the form of an upstanding largely cylindrical post, said connecting apparatus includes an electrically conductive battery connector having a front end constructed to be fixed to the vehicle battery terminal, said battery connector having a rear end with a mateable first contact, said connecting apparatus includes an electrically conductive cable connector with a rear end that is connectable to said cable conductor and a front end that forms a second contact that is mateable with said first contact, one of said contacts comprising a pin contact and the other comprising a socket contact that receives the pin contact, to connect the cable to the vehicle battery terminal, said connecting apparatus being constructed to lock said battery connector and said cable connector together, wherein:

said battery connector includes an electrically conductive platform having a front end forming a post-receiving hole and a rear end;

said cable connector forms a pair of catch arms with largely rearwardly-facing catch shoulders that can be laterally deflected, said catch arms laying on opposite side of said such first contact;

said platform rear end has an integral upstanding rail forming said second contact, said rail having opposite sides forming largely forwardly-facing rail shoulder, said catch shoulders being deflectable to pass forwardly across said rail shoulders and to then deflect so said catch shoulders lie forward of said rail shoulders, to lock said connectors together.

4. The apparatus described in claim 3, wherein:

said first contact is in the form of a pin, and said second contact is in the form of a socket;

said rail has a rear end forming a recess, and a portion of said pin lies in said recess.

5. The apparatus described in claim 3 wherein:

a first of said connectors has a guide strip that is elongated along the direction of mating of said connectors and projects toward the second connector, and the second connector has a slot that opens towards said guide strip and hat receives said guide strip as said connectors approach each other and before said pin and socket contacts mate, said guide strip and said slot each lying at one side of the contacts.

* * * * *